US005863381A

United States Patent [19]

Magota et al.

[11] Patent Number: 5,863,381

[45] Date of Patent: Jan. 26, 1999

[54] FILM JOINING APPARATUS

[75] Inventors: Katsuji Magota, Osaka; Katsuhiro Yamaguchi; Yousuke Kanamori, both of Tokyo; Masashi Watanabe, Yokohama; Yukihisa Kumeta, Tokyo, all of Japan

[73] Assignee: Tetra Laval Holdings & Finance S.A., Switzerland

[21] Appl. No.: 817,530

[22] PCT Filed: Oct. 17, 1995

[86] PCT No.: PCT/JP95/02127

§ 371 Date: Apr. 17, 1997

§ 102(e) Date: Apr. 14, 1997

[87] PCT Pub. No.: WO96/11845

PCT Pub. Date: Apr. 25, 1997

[30] Foreign Application Priority Data

Oct. 17, 1994 [JP] Japan ..... 6-250975

[51] Int. Cl.[6] ..... B65H 21/00

[52] U.S. Cl. ..... 156/507; 156/502; 156/159; 242/554.2; 242/554.4

[58] Field of Search ..... 156/159, 502, 156/507, 583.4; 242/551, 554, 554.2, 554.4

[56] References Cited

U.S. PATENT DOCUMENTS

| | | | |
|---|---|---|---|
| 3,390,038 | 6/1968 | Hadley | 156/159 |
| 3,796,625 | 3/1974 | Rutledge | 156/159 X |
| 3,956,047 | 5/1976 | Johnson | 156/159 |
| 4,999,081 | 3/1991 | Buchanan | 156/583.4 X |
| 5,312,507 | 5/1994 | Miller | 156/583.4 X |
| 5,318,646 | 6/1994 | Cardini et al. | 156/507 X |
| 5,403,413 | 4/1995 | Masuda | 156/502 X |
| 5,514,237 | 5/1996 | Emenaker et al. | 156/159 |
| 5,573,617 | 11/1996 | Franck et al. | 156/515 X |
| 5,653,848 | 8/1997 | Yamamoto et al. | 156/159 X |
| 5,709,761 | 1/1998 | Tajima et al. | 156/507 X |

FOREIGN PATENT DOCUMENTS

| | | |
|---|---|---|
| 3203644 | 8/1982 | Germany . |
| 3409702 | 10/1984 | Germany . |
| 4013345 | 11/1991 | Germany . |
| 1184591 | 3/1970 | United Kingdom . |

*Primary Examiner*—Mark A. Osele
*Attorney, Agent, or Firm*—Lorusso & Loud

[57] ABSTRACT

A film joining apparatus includes a first transport path (31) along which an old film (12) is transported and onto which a new film (15) whose leading end has been taken out is set, a second transport path (32) which is connected to the first transport path (31) and along which the old film (12) is transported, and a branch path (34) which is branched from the first transport path (31) and the second transport path (32) at a connecting section (33) therebetween. The apparatus further includes a heat fusion unit (40) disposed at the branch path (34) to join the tail end of the old film (12) and the leading end of the new film (15) by heat fusion, and a blower (39) disposed facing the connecting section (33) and adapted to jet an operating gas. The leading end of the new film (15) is introduced into the deepest portion of the branch path (34) in advance. When the operating gas is jetted from the blower (39), the old film (12) is pushed into the branch path (34) due to the pressure of the operating gas, so that the tail end of the old film (12) reaches the deepest portion of the branch path (34). Since it is not necessary to insert a pusher or the like into the branch path (34), static electricity is prevented from being generated in the pusher, the branch path (34), etc.

12 Claims, 8 Drawing Sheets

FILM JOINING APPARATUS

TECHNICAL FIELD

The present invention relates to a film joining apparatus.

BACKGROUND ART

Conventionally, a predetermined number of packaging containers which have been discharged from a filling machine after being filled with contents are stacked in a packing pattern, and are wrapped by a heat-shrinkable film such as polyethylene film.

The film formed in an elongated shape is rolled and is set on a payoff machine as a film roll. The film supplied from the payoff machine is continuously fed to a shrink packaging machine. The film is cut in the shrink packaging machine when a predetermined amount is used for packaging.

When a film roll is used up during a continuous packaging operation, a new film roll (hereinafter referred to as a "new roll") is set on the payoff machine, and film is taken out from the new roll. Since the wrapping of packaging containers is continuously performed at the shrink packaging machine, the tail end of a previously used film roll (hereinafter referred to as an "old roll") is joined with the leading end of the new roll, With this joining operation, film can be continuously supplied to the shrink packaging machine.

FIG. 1 is an illustration showing a conventional film joining apparatus in a state before joining films. FIG. 2 is an illustration showing the conventional film joining apparatus in a state after joining the films.

In these drawings, numeral 11 denotes an old roll, numeral 12 denotes an old film which is taken out from the old roll 11 by an unillustrated payoff machine, numeral 14 denotes a new roll, numeral 15 denotes a new film which is taken out from the new roll 14 by an unillustrated payoff machine. While the old film 12 is taken out from the old roll 11, the new roll 14 is set on the payoff machine, as shown in FIG. 1. After that, the leading end of the new film 15 is pulled out.

Numeral 18 denotes ultrasonic sensors which are disposed along the transport paths of the films 12 and 15 in order to detect the tail ends of the taken-out films 12 and 15. Numerals 20 and 21 denote a pair of opposing heaters which are adapted to separate and approach each other. When the ultrasonic sensor 18 detects the tail end of the old film 12, an unillustrated controller causes the heaters 20 and 21 to approach each other. The heaters 20 and 21 nip the old film 12 in the vicinity of the tail end thereof and the leading end of the new film 15, and heat them, thereby fusing and joining them at a joining point a, as shown in FIG. 2. With this operation, the old film 12 and the new film 15 are joined with each other. Numeral 12*a* denotes a residual flap of the old film 12 which is formed on the rear side of the joining point a.

However, when the old film 12 and the new film 15 are joined with each other in the conventional film joining apparatus, the controller starts the movement of the heaters 20 and 21 at the time when the tail end of the old film 12 passes by the ultrasonic sensor 18.

Since the amount of the old film 12 taken out from the old roll 11 varies depending on the packing pattern in which packaging containers are stacked, it is difficult to position the tail end of the old film 12 between the heaters 20 and 21 for fusion. Accordingly, a residual flap 12*a* of the old film 12 is formed on the rear side of the joining point As a result, when the new film 15 is taken out from the new roll 14 without removing the residual flap 12*a,* a machine in a succeeding stage will not operate properly. Therefore, an operation for stopping the machine and removing the residual flap 12*a* must be performed before the residual flap 12*a* enters the machine in the succeeding stage.

An object of the present invention is to solve the problems of the conventional film joining apparatus and to provide a film joining apparatus which prevents a residual flap from being formed on the rear side of a joining point when film of an old roll and film of a new roll are joined, thereby eliminating the necessity of stopping a machine in a succeeding stage.

DISCLOSURE OF THE INVENTION

To achieve the above object, a film joining apparatus according to the present invention comprises a first transport path along which an old film is transported and onto which a new film whose leading end has been taken out is set, a second transport path which is connected to the first transport path and along which the old film is transported, and a branch path which is branched from the first transport path and the second transport path at a connecting section therebetween.

The apparatus further comprises a heat fusion unit disposed at the branch path to join the tail end of the old film and the leading end of the new film by heat fusion, and a blower disposed facing the connecting section and adapted to jet an operating gas.

In the apparatus, the leading end of a new film is introduced into the deepest portion of the branch path in advance, and an operating gas is then jetted from the blower. Consequently, an old film is pushed into the branch path due to the pressure of the operating gas, so that the tail end of the old film reaches the deepest portion of the branch path.

Accordingly, it is not necessary to insert a pusher or the like into the branch path so as to place the tail end of the old film at the deepest portion of the branch path. This prevents the generation of static electricity in the pusher, the branch path, etc. As a result, the old film and the new film are prevented from adhering to a wall of the branch path or from bending due to static electricity. Accordingly, the heat fusion operation can be carried out smoothly.

The heat fusion unit then joins the tail end of the old film and the leading end of the new film by heat fusion.

In another film joining apparatus according to the present invention, the heat fusion unit comprises a counter member, a heater disposed to face the counter member with the branch path being located therebetween, and moving means for advancing and retracting the heater. The heater holds the old film and the new film in cooperation with the counter member to press and heat them, thereby thermally fusing and joining the old film and the new film, and cuts off a flap portion from the joined films.

At this time, the maximum pressure is generated at a portion where the counter member and the heater lie in the closest proximity to each other, so that the melted resin is pushed toward both sides of the pressed portion due to the maximum pressure. With this operation, the flap portion is cut away from the joined films.

In still another film joining apparatus according to the present invention, the counter member is made of an elastic material.

In this case, when the heater is advanced, the surface of the counter member is temporarily retracted due to the pushing force from the heater to form a depression in the surface. However, the counter member restores its original shape as the resin is melted. Accordingly, the counter member can push the melted resin toward both sides of the pressed portion more effectively.

Still another film joining apparatus according to the present invention further comprises an end sensor for detecting the tail end of an old film, and a controller.

The controller is provided with stopping means which temporarily stops the transport of an old film at a preset stop timing when the tail end of the old film is detected by the end sensor.

Therefore, it is possible to temporarily stop the transport of an old film at the preset stop timing when the tail end of the old film is detected by the end sensor.

In still another film joining apparatus according to the present invention, the stop timing is set such that when an old film is stopped, the distance between the tail end of the old film in the first transport path and the connecting section is greater than the distance between the connecting section and a holding unit provided at the branch path.

Consequently, when the old film is pushed into the branch path due to the pressure of the operating gas from the blower, the tail end of the old film reaches the deepest portion of the branch path and a sufficient length of area can be formed for heat fusion.

Still another film joining apparatus according to the present invention further comprises an end sensor for detecting the tail end of an old film, and a controller.

The controller is provided with jet start means for starting the jet of the operating gas from the blower at a preset jet start timing when the tail end of the old film is detected by the end sensor.

Therefore, the operating gas starts being jetted from the blower at the preset jet start time when the tail end of the old film is detected by the end sensor.

In still another film joining apparatus according to the present invention, the jet start timing is set such that when an old film is stopped, the distance between the tail end of the old film in the first transport path and the connecting section is greater than the distance between the connecting section and a holding unit provided at the branch path.

Consequently, when the old film is pushed into the branch path due to the pressure of the operating gas from the blower, the tail end of the old film reaches the deepest portion of the branch path and a sufficient length of area can be formed for heat fusion.

BEST MODE FOR CARRYING OUT THE INVENTION

The embodiment of the present invention will next be described with reference to the drawings.

Figure 1:
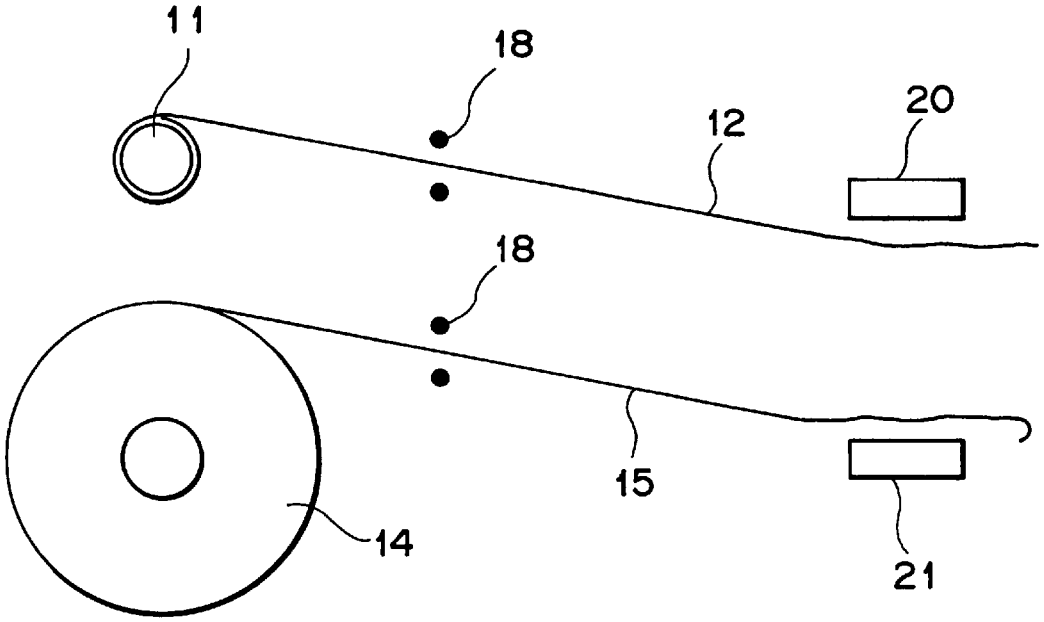
FIG. 1 (PRIOR ART)
FIG. 1 is an illustration showing a conventional film joining apparatus in a state before joining films.
Figure 2:
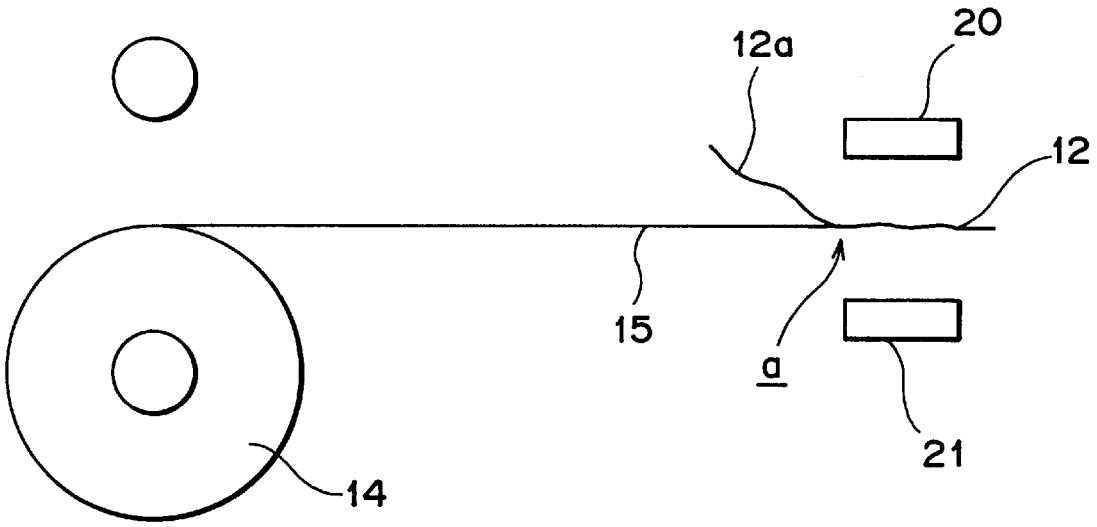
FIG. 2 (PRIOR ART)
FIG. 2 is an illustration showing the conventional film joining apparatus in a state after joining the films.
Figure 3:
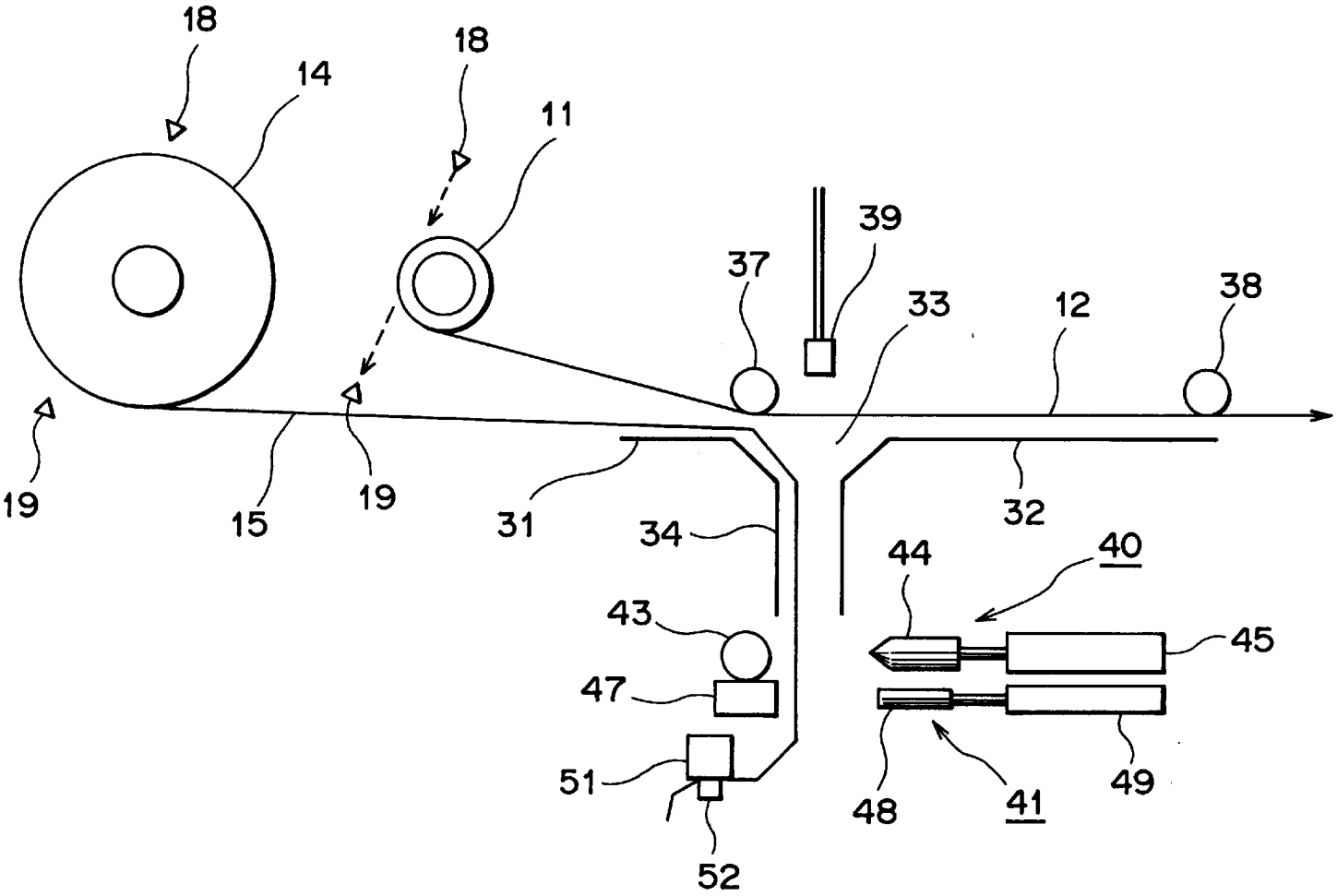
FIG. 3 is an illustration showing the first state of a film joining apparatus in an embodiment of the present invention.
Figure 4:
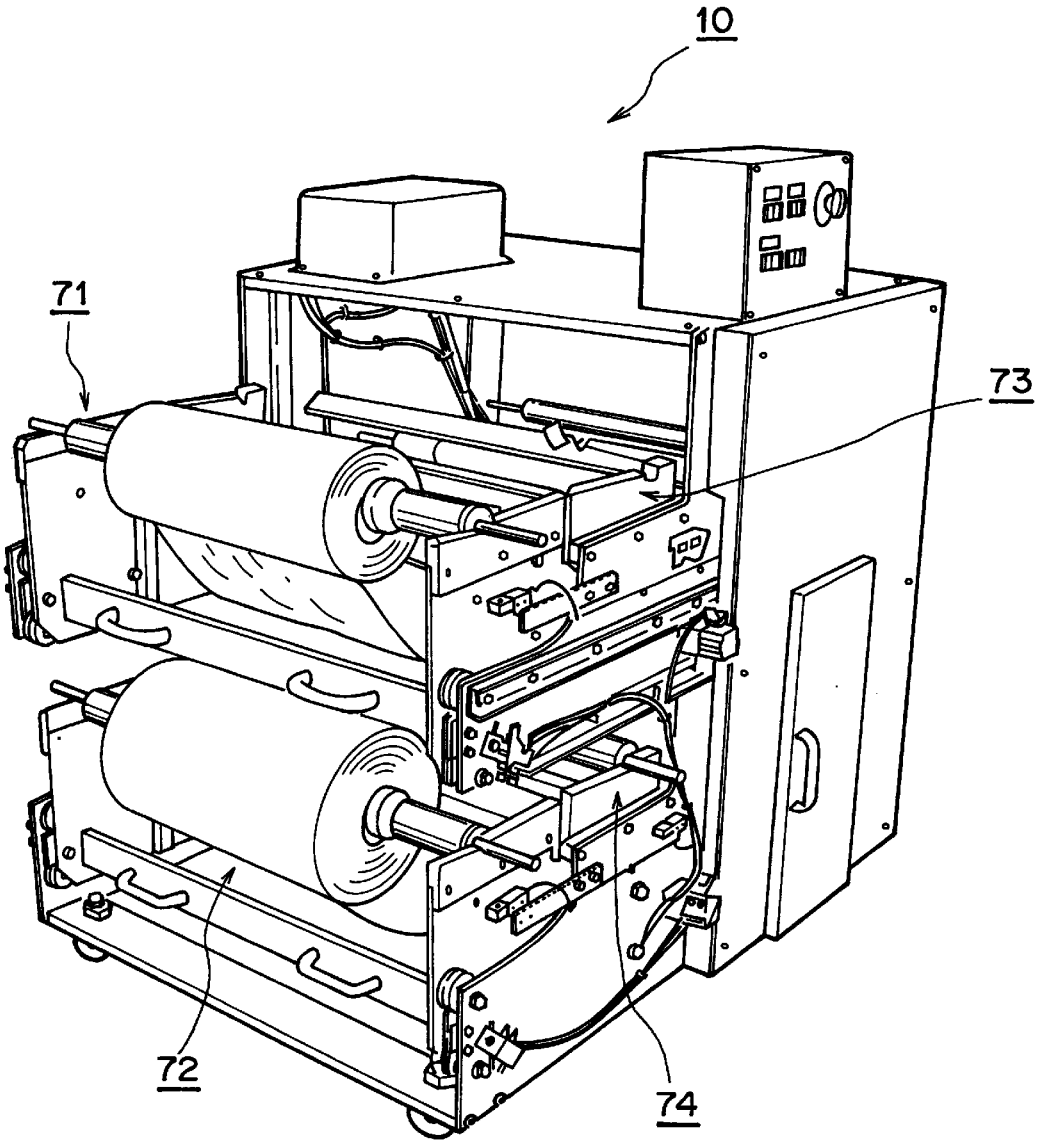
FIG. 4 is a perspective view of a film supply apparatus in the embodiment of the present invention.
Figure 5:
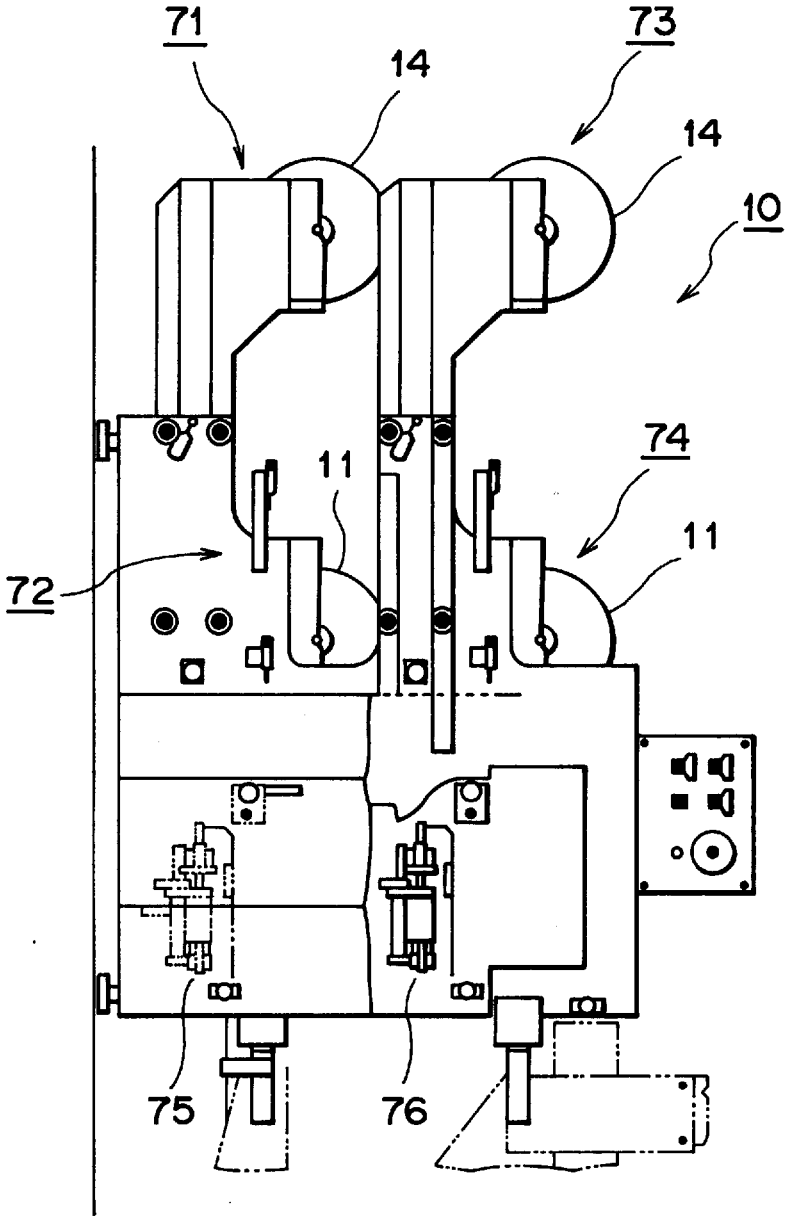
FIG. 5 is a side view of the film supply apparatus in the embodiment of the present invention.

FIG. 3 is an illustration showing the first state of a film joining apparatus in an embodiment of the present invention, FIG. 4 is a perspective view of a film supply apparatus in the embodiment of the present invention, and FIG. 5 is a side view of the film supply apparatus in the embodiment of the present invention.

In FIG. 4 and FIG. 5, numeral 10 denotes a film supply apparatus. In the present embodiment, a predetermined number of unillustrated packaging containers which have been stacked in a packing pattern are wrapped from below and above the packaging containers. Therefore, the film supply apparatus 10 is provided with payoff machines 71 and 72 for supplying a film below the packaging containers, and payoff machines 73 and 74 for supplying a film above the packaging containers. New rolls 14 are set on the payoff machines 71 and 73 while old rolls 11 are set on the payoff machines 72 and 74. Film joining apparatuses 75 and 76 are disposed under the payoff machines 72 and 74.

Next, the film joining apparatuses 75 and 76 will be described.

In FIG. 3, numeral 11 denotes an old roll, numeral 12 denotes an old film taken out from the old roll 11 by the payoff machine 72 or 74 (see FIG. 4), numeral 14 denotes a new roll, numeral 15 denotes a new film taken out from the new roll 14 by the payoff machine 71 or 73. In the present embodiment, each of the films 12 and 15 is a single layer film made of polyethylene. However, the films 12 and 15 may be made of other resins. While the old film 12 is taken out from the old roll 11, the new roll 14 is set on the payoff machine 71 or 73, and the leading end of the new film 15 is taken out.

When the old film 12 is completely taken out from the old roll 11, the tail end of the old film 12 and the leading end of the new film 15 are joined with each other by heat fusion.

For this purpose, there are formed a first transport path 31 along which the old film 12 taken out of the old roll 11 is transported and onto which the new film 15 whose leading end has been taken out is set, a second transport path 32 which is connected to the first transport path 31 and along which the old film 12 is transported, and a branch path 34 which is branched from a connecting section (area) 33 between the first transport path 31 and the second transport path 32 such that the branch path 34 perpendicularly extends with respect to the transport paths 31 and 32. A guide roller 37 is disposed along the first transport path 31 before the connecting section 33 and a guide roller 38 is disposed along the second transport path 32 so as to guide the old film 12.

An end sensor composed of a photo sensor is disposed in the vicinity of each of the payoff machines 71–74. The completion of taking out of the old film 12 from the old roll 11 can be detected by detecting the tail end of the old film 12 by the end sensor. The end sensor comprises, for example, a photo diode 18 and a photo transistor 19. When the old film 12 is left on the old roll 11, light emitted by the photo diode 18 is blocked off by the old film 12 so that the light does not reach the photo transistor 19. When the old film 12 has been mostly or completely taken out from the old roll 11, the light emitted by the photo diode 18 reaches the photo transistor 19. In this way, the completion of taking out of the old film 12 from the old roll 11 can be detected.

To Join the tail end of the old film 12 and the leading end of the new film 15 with each other by heat fusion, a blower 39 is disposed such that it faces the connecting section 33. Further, a heat fusion unit 40, and a holding unit 41 are provided along the branch path 34.

The blower 39 has an opening directed to the connecting section 33 and the branch path 34, and jets an operating gas supplied from an unillustrated operating gas supply source. The opening of the blower 39 is a slit longer than the width of the old film 12. Therefore, pressure produced by the operating gas acts on the old film 12 over the entire width thereof. Air, inert gas, nitrogen gas or the like can be used as the operating gas in a pressurized or unpressurized state.

The heat fusion unit 40 is disposed such that it faces the branch path 34. The heat fusion unit 40 includes a cylindrical counter roller 43 which has a length greater than the widths of the films 12 and 15 and serves as a counter member, a heater 44 disposed to face the counter roller 43 with the branch path 34 being located therebetween, and a piston cylinder 45 serving as a moving means for advancing and retracting the heater 44. The tip of the heater 44 extends in the widthwise direction of the films 12 and 15.

The holding unit 41 is disposed such that it faces the branch path 34. The holding unit 41 includes a counter bar 47 having a length greater than the widths of the films 12 and 15, a film holder 48 disposed to face the counter bar 47 with the branch path 34 being located therebetween, and a moving cylinder 49 for advancing and retracting the film holder 48. The tip of the film holder 48 extends in the widthwise direction of the films 12 and 15.

Numeral 51 denotes a holding frame disposed at the deepest portion of the branch path 34, and numeral 52 denotes a permanent magnet which is attracted by the holding frame 51 to hold the leading end of the new film 15.

Next, operation of the film joining apparata 75 and 76 having the above-described structure will be described.

Figure 6:
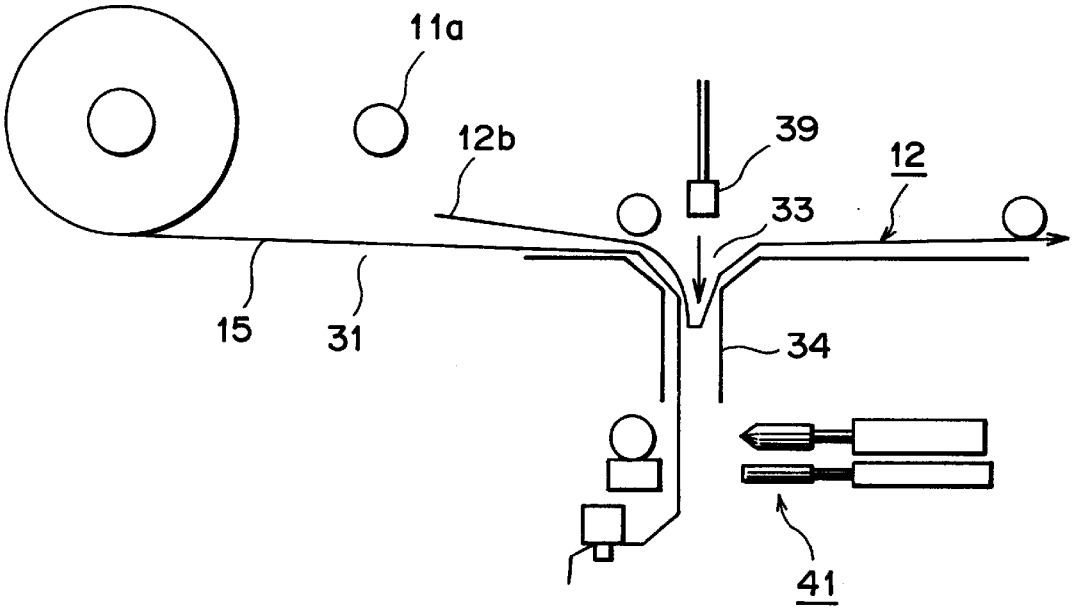
FIG. 6 is an illustration showing the second state of the film joining apparatus in the embodiment of the present invention.
Figure 7:
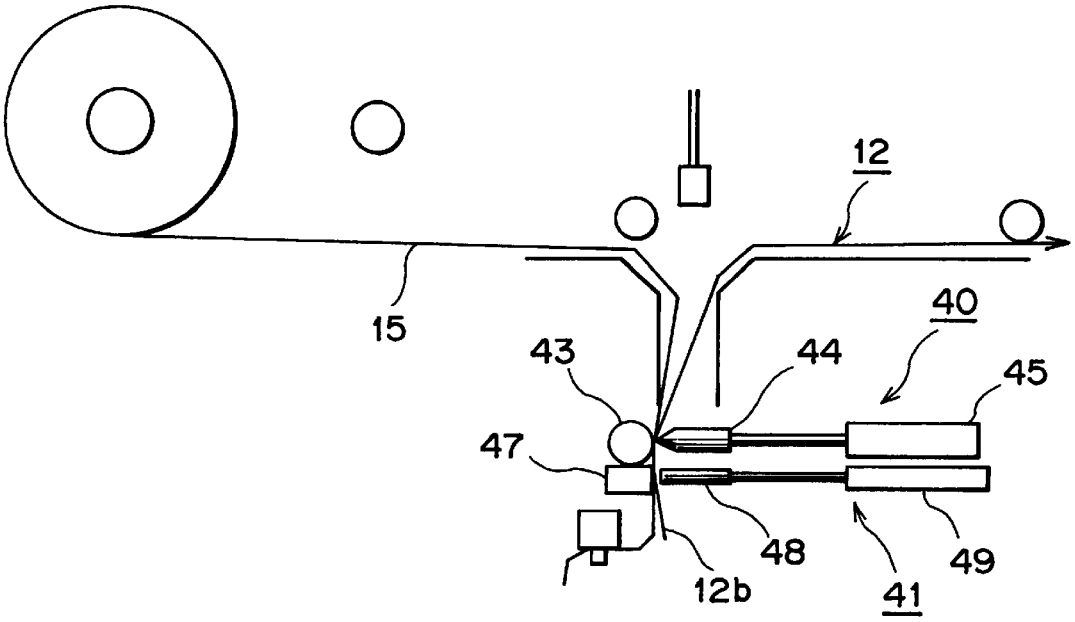
FIG. 7 is an illustration showing the third state of the film joining apparatus in the embodiment of the present invention.
Figure 8:
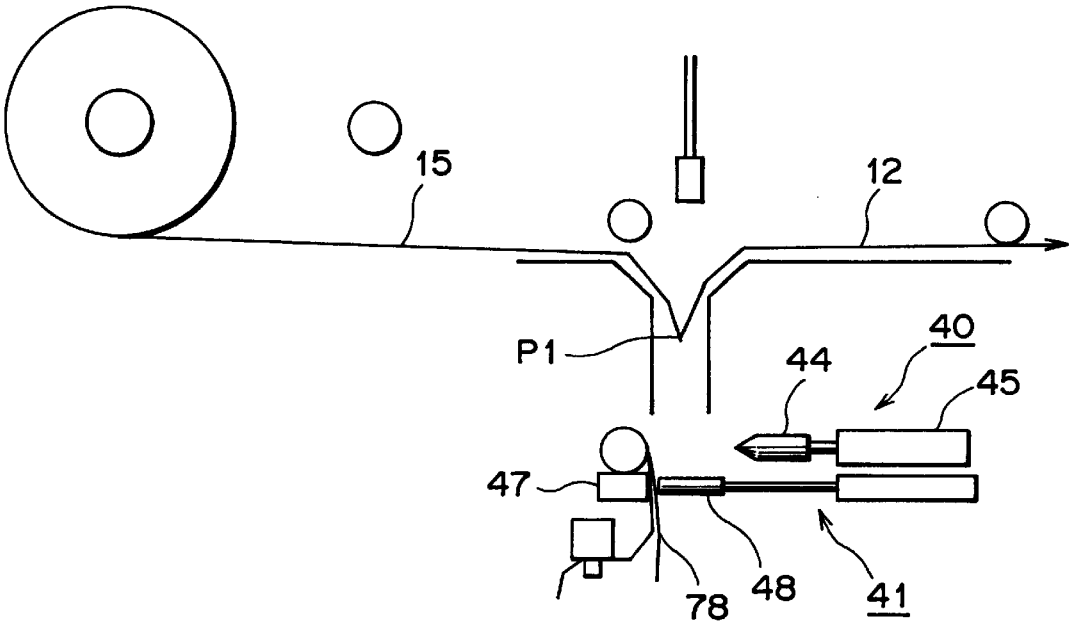
FIG. 8 is an illustration showing the fourth state of the film joining apparatus in the embodiment of the present invention.
Figure 9:
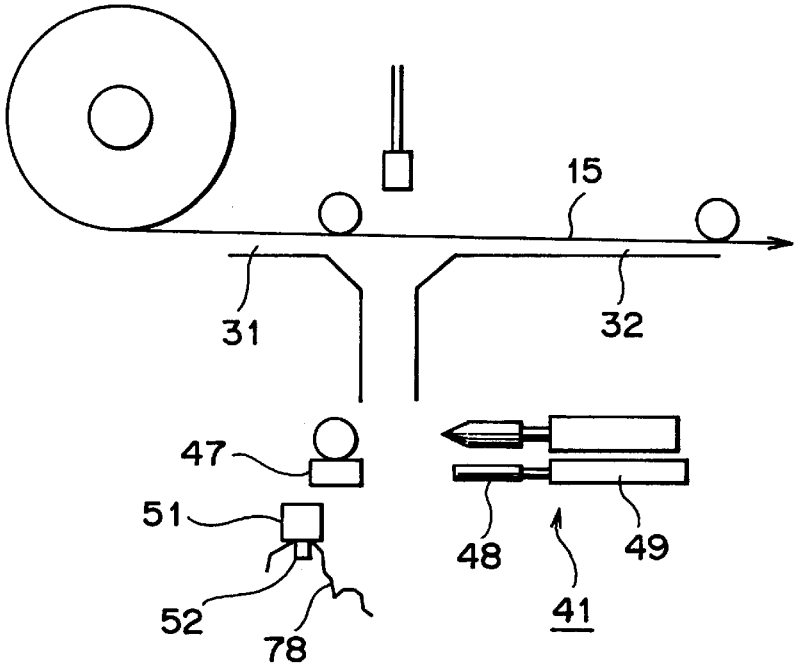
FIG. 9 is an illustration showing the fifth state of the film joining apparatus in the embodiment of the present invention.

FIG. 6 is an illustration showing the second state of the film joining apparatus in the embodiment of the present invention, FIG. 7 is an illustration showing the third state of the film joining apparatus in the embodiment of the present invention, FIG. 8 is an illustration showing the fourth state of the film joining apparatus in the embodiment of the present invention, and FIG. 9 is an illustration showing the fifth state of the film joining apparatus in the embodiment of the present invention.

In the first state of the film joining apparatus shown in FIG. 3, the leading end of the new film 15 is led to the deepest portion of the branch path 34 in advance and is held by the holding frame 51 and the permanent magnet 52.

After that, an operating gas is jetted from the blower 39 at a preset jet start timing, as shown in FIG. 6. As a result, the old film 12 is pushed into the branch path 34 due to the pressure of the operating gas. At this time, the taking out of the old film 12 has been already completed and the tail end 12*b* of the old film 12 has left a roll core 11*a*. Therefore, as the old film 12 is pushed into the branch path 34, the tail end 12*b* enters the branch path 34 and reaches the deepest portion of the branch path 34.

Accordingly, it is unnecessary to insert a pusher or the like into the branch path 34 so as to place the tail end 12*b* of the old film 12 at the deepest portion of the branch path 34 or to reciprocate the pusher or the like within the branch path 34. This prevents the generation of static electricity in the pusher, the branch path 34, etc. As a result, the old film 12 and the new film 15 are prevented from adhering to a wall of the branch path 34 or from bending due to static electricity. Accordingly, the heat fusion operation can be carried out smoothly.

When the tail end 12*b* of the old film 12 is detected by the end sensor, stop means of an unillustrated controller temporarily stops the transport of the old film 12 at the preset stop timing. Also, jet start means of the controller sends a command to the blower 39 to start jetting of the operating gas at a preset jet start timing.

The timing for stopping the transport of the old film 12 and the timing for starting the jetting of the operating gas are set such that the distance between the tail end 12*b* of the old film 12 in the first transport path 31 and the connecting section 33 is larger than the distance between the connecting section 33 and the holding unit 41 provided at the branch path 34. Consequently, the tail end 12*b* of the old film 12 can reach the deepest portion of the branch path 34 and a sufficient length of area can be formed for heat fusion.

After that, the moving cylinder 49 of the holding unit 41 is operated to advance the film holder 48, as shown in FIG. 7. With this operation, the new film 15 and the old film 12 are pressed against the counter bar 47 while being superposed on one another. At the same time, or after a short period of time has elapsed, the moving cylinder 45 of the heat fusion unit 40 is operated to advance the heater 44. As a result, the new film 15 and the old film 12 are pressed against the counter roller 43 and are heated so that they are joined with each other by heat fusion. At this time, while the new film 15 and the old film 12 are joined at the fused portion, a flap portion is cut off from the joined films. In the present embodiment, the heater 44 is an electric heater.

Subsequently, as shown in FIG. 8, the moving cylinder 45 of the heat fusion unit 40 is operated to retract the heater 44 to the original position. As a result, the new film 15 and the old film 12 fused and joined via a joined portion P1 is pulled by an unillustrated machine in a succeeding stage. At this time, a flap portion 78 is still pressed against the counter bar 47 by the film holder 48 of the holding unit 41.

After that, as shown in FIG. 9, the moving cylinder 49 of the holding unit 41 is operated to retract the film holder 48 to the original position. As a result, the flap portion 78 is released from the counter bar 47 and is held by the holding frame 51 and the permanent magnet 52.

Here, heat fusion carried out by the heat fusion unit 40 will be described.

Figure 10:
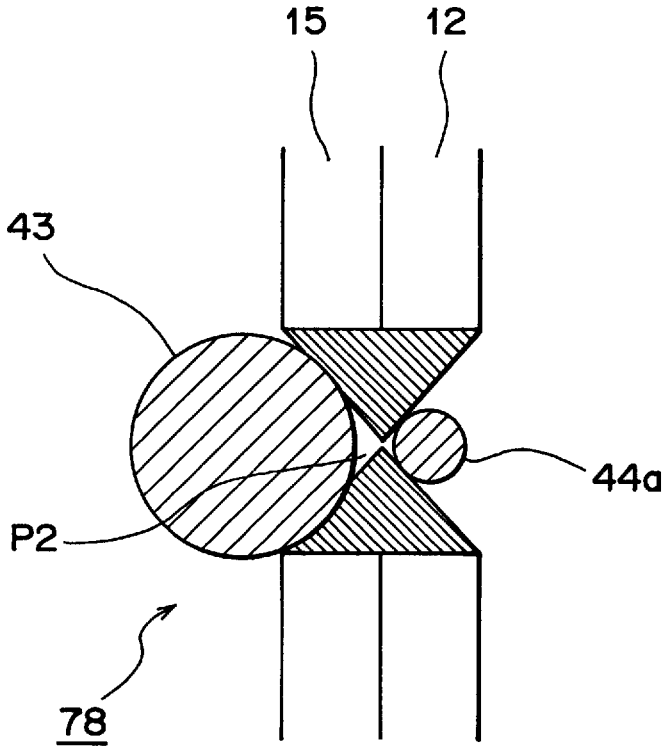
FIG. 10 is an illustration for explaining operation of a heat fusion unit used in the embodiment of the present invention.
Figure 11:
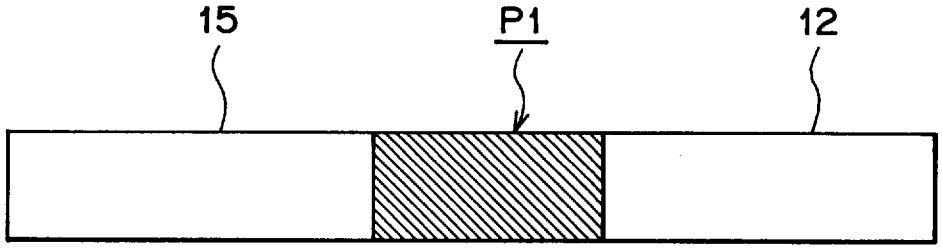
FIG. 11 is an illustration of the state of films after being joined by heat fusion in the embodiment of the present invention.

FIG. 10 is an illustration for explaining operation of a heat fusion unit used in the embodiment of the present invention, and FIG. 11 is an illustration of the state of films after being joined by heat fusion in the embodiment of the present invention.

In these drawings, numeral 12 denotes an old film, numeral 15 denotes a new film, numeral 43 denotes a cylindrical counter roller serving as a counter member, and numeral 44*a* denotes a heating member which is disposed to face the counter roller 43 and is advanced toward and retracted from the counter roller 43. The heating member 44*a* is disposed at the tip of the heater 44 (FIG. 3) and comprises a resistance heating element. In the present embodiment, the counter roller 43 has a diameter of 30 mm, and the heating member 44*a* has a diameter of 0.5–1 mm.

When the heater 44 is advanced to press the tail end of the old film 12 and the leading end of the new film 15 against the counter roller 43 for pressing these films, and heating is instantaneously performed in this state, resin of the portion nipped by the counter roller 43 and the heating member 44*a* is fused so that the old film 12 and the new film 15 are joined together. A turbulent flow is produced in the fused resin, the joining by heat fusion can be properly performed.

At this time, the maximum pressure is generated at a portion P2 where the counter roller 43 and the heating member 44*a* lie in the closest proximity to each other, so that the melted resin is pushed toward both sides (the side facing the joined films 12 and 15, and the side facing the flap portion 78) due to the pressure from the counter roller 43 and the heating member 44*a*. The counter roller 43 and the heating member 44*a* finally contact each other. With this operation, the flap portion 78 can be cut off from the films 12 and 15.

To instantaneously heat the tail end of the old film 12 and the leading end of the new film 15, an unillustrated current control circuit is connected to the heating member 44*a*. The current control circuit supplies current to the heating member 44*a* by using thyristors.

As described above, by nipping with pressure and by heating the films 12 and 15 using the counter roller 43 and the heating member 44*a*, not only the tail end of the old film 12 and the leading end of the new film 15 can be joined by heat fusion but also the flap portion 78 can be cut off from the films 12 and 15. Accordingly, a cutting device is unnecessary. In addition, the size of the film joining apparatus can be decreased, and costs can be reduced. Moreover, the joined portion P1 can be made flat, as shown in FIG. 11.

Furthermore, the counter roller 43 may be made of an elastic material. In this case, when the heater 44 is advanced, the surface of the counter roller 43 is temporarily retracted due to the pushing force from the heater 44 to form a depression in the surface. However, the counter roller 43 restores its original shape as the resin is melted. Accordingly, the counter roller 43 can push the melted resin toward both sides more effectively. Although the cylindrical counter roller 43 is used in the present embodiment, a flat elastic member may be used in place of the counter roller 43.

The present invention is not limited to the above-described embodiment. Numerous modifications and variations of the present invention are possible in light of the spirit of the present invention, and they are not excluded from the scope of the present invention.

We claim:

1. A film joining apparatus comprising:

(a) means for defining a first transport path along which an old film is transported and onto which a leading end taken out from a new film is set;

(b) means for defining a second transport path, which is aligned with and spaced by a gap from said means defining said first transport paths and along which the old film is transported, whereby said first and second transport paths together form a linear transport path;

(c) means for defining a branch path which is bypassed by said linear transport path, said branch path being branched from said linear transport path at said gap;

(d) a heat fusion unit disposed remote from said linear transport path and in line with said branch path for joining a transverse section of the old film near a tail end thereof and a transverse section of the new film near the leading end by heat fusion; and (e) a blower disposed facing said gap for emitting a jet of an operating gas against the leading end of the new film and the tail end of the old film, to divert the ends from said linear transport path, and to force the ends along said branch path and then through said heat fusion unit to a location on a side of said heat fusion unit opposite said gap.

2. A film joining apparatus according to claim 1, in which said heat fusion unit comprises a counter member, a heater disposed facing said counter member with said branch path being located therebetween, and moving means for moving the heater between advanced and retracted positions defining a heater travel path therebetween, said heater travel path intersecting said branch path but not said linear transport path, said heater nipping the old film and the new film, in cooperation with said counter member, in said advanced position to press them together and to heat them, thereby thermally fusing and joining the old film and the new film, and to form a flap portion from the joined films between the ends and said heat fusion unit and to cut off the flap portion.

3. A film joining apparatus according to claim 2, in which said counter member is made of an elastic material.

4. A film joining apparatus according to claim 2 wherein said branch path is perpendicular to said linear transport path and wherein said blower is located vertically above said gap and said heat fusion unit is located vertically below said gap, separated from said gap by said means defining the branch path.

5. A film joining apparatus according to claim 4 further comprising holding means, positioned at said location, for temporarily holding at least one of the two ends, said holding means being located vertically beneath said heat fusion unit.

6. A film joining apparatus according to claim 1, further comprising an end sensor for detecting the tail end of an old film, and a controller including stopping means for temporarily stopping transport of the old film at a preset stop timing when the tail end of the old film is detected by said end sensor.

7. A film joining apparatus according to claim 6, further comprising holding means, positioned at said location, for temporarily holding at least one of the two ends and wherein said stop timing is set such that when an old film is stopped, the distance between the tail end of the old film in said first transport path and said gap is greater than the distance between said gap section holding means.

8. A film joining apparatus according to claim 1, further comprising an end sensor for detecting the tail end of an old film, and a controller including jet start means for starting the jet of the operating gas from said blower at a preset jet start timing when the tail end of the old film is detected by said end sensor.

9. A film joining apparatus according to claim 8, further comprising holding means, positioned at said location, for temporarily holding at least one of the two ends and wherein said jet start timing is set such that when an old film is stopped, the distance between the tail end of the old film in said first transport path and said gap is greater than the distance between said gap and said holding means.

10. A film joining apparatus according to claim 1 further comprising holding means, positioned at said location, for temporarily holding at least one of the two ends.

11. A film joining apparatus according to claim 1 wherein said branch path is perpendicular to said linear transport path and wherein said blower is located vertically above said gap and said heat fusion unit is located vertically below said gap, separated from said gap by said means defining the branch path.

12. A film joining apparatus according to claim 11 further comprising holding means, positioned at said location, for temporarily holding at least one of the two ends, said holding means being located vertically beneath said heat fusion unit.

* * * * *

UNITED STATES PATENT AND TRADEMARK OFFICE

CERTIFICATE OF CORRECTION

PATENT NO. : 5,863,381

DATED : January 26, 1999

INVENTOR(S) : MAGOTA et al

It is certified that error appears in the above-identified patent and that said Letters Patent is hereby corrected as shown below:

Col. 1, line 65, after "point" insert --a. --

Col. 7, line 48, delete "paths" insert --path--.

Col. 8, line 38, delete "section" insert --and said--.

Signed and Sealed this
First Day of February, 2000

*Attest:*

*Attesting Officer*

Q. TODD DICKINSON

*Acting Commissioner of Patents and Trademarks*